United States Patent [19]

Hess et al.

[11] Patent Number: 4,935,588

[45] Date of Patent: Jun. 19, 1990

[54] CONTACT ARRANGEMENT FOR VACUUM SWITCHES WITH AXIAL MAGNETIC FIELDS

[75] Inventors: Ruediger Hess, Berlin; Horst Kippenberg, Herzogenaurach; Wilfried Kuhl, Wendelstein; Wolfgang Schlenk, Erlangen/Eltersdorf; Ernst-Ludwig Hoene, Berlin; Reiner Mueller, Steinbach, all of Fed. Rep. of Germany

[73] Assignee: Siemens Aktiengesellschaft, Berlin & Munich, Fed. Rep. of Germany

[21] Appl. No.: 273,857

[22] PCT Filed: Mar. 20, 1987

[86] PCT No.: PCT/DE87/00124

§ 371 Date: Sep. 23, 1988

§ 102(e) Date: Sep. 23, 1988

[87] PCT Pub. No.: WO87/06052

PCT Pub. Date: Oct. 8, 1987

[30] Foreign Application Priority Data

Mar. 26, 1986 [DE] Fed. Rep. of Germany ..... 3610245
Mar. 26, 1986 [DE] Fed. Rep. of Germany ..... 3610242

[51] Int. Cl.[5] ..... H01H 33/66
[52] U.S. Cl. ..... 200/144 B
[58] Field of Search ..... 200/144 B

[56] References Cited

U.S. PATENT DOCUMENTS

| | | | |
|---|---|---|---|
| 3,327,081 | 6/1967 | Pflanz | 200/144 |
| 3,946,179 | 3/1976 | Murano et al. | 200/144 |
| 4,210,790 | 7/1980 | Kurosawa et al. | 200/144 |
| 4,532,391 | 7/1985 | Bernt | 200/144 |
| 4,618,750 | 10/1986 | Zueckler | 200/144 |

FOREIGN PATENT DOCUMENTS

| | | |
|---|---|---|
| 0052371 | 5/1982 | European Pat. Off. . |
| 0155584 | 9/1985 | European Pat. Off. . |
| 0055008 | 12/1985 | European Pat. Off. . |
| 0167479 | 1/1986 | European Pat. Off. . |
| 2443141 | 7/1975 | Fed. Rep. of Germany . |
| 3231593 | 3/1984 | Fed. Rep. of Germany . |
| 0980946 | 1/1965 | United Kingdom . |

OTHER PUBLICATIONS

IEEE Transactions on Power Apparatus and Systems, vol. PAS-99, No. 6, (1980), pp. 2079-2085.

*Primary Examiner*—Robert S. Macon
*Attorney, Agent, or Firm*—Kenyon & Kenyon

[57] ABSTRACT

Contact pieces for vacuum switches with axial magnetic field are designed e.g. as cup contacts with slotting in the same direction which support a diskshaped contact body and have means for the suppression of eddy currents. According to the invention, the contact bodies (10, 20, 30, 40, 50) have, at least on their backside, radial areas (15, 25, 35, 45, 55) of markedly lower electrical conductivity than the base material. Such radial areas may be, grooves (15 to 18) on the backside (12) of the contact body (10), diffusion zones (25, 35) of additives reducing the electrical conductivity of the base material, or combinations of the two. If the contact bodies (40,50) are made by powder metallurgical methods, it is also possible to provide the radial areas during production as fillings (45) or as molded parts (55) of a material of lower electrical conductivity than that of the base material.

15 Claims, 3 Drawing Sheets

CONTACT ARRANGEMENT FOR VACUUM SWITCHES WITH AXIAL MAGNETIC FIELDS

BACKGROUND OF THE INVENTION a. Field of the Invention

The invention relates to a contact arrangement for vacuum switches with an axial magnetic field, having contact pieces which contain contact bodies as a base material. The contact bodies are soldered to contact carriers and, for the reduction of eddy currents, have radial areas of less electrical conductivity than the base material.

b. Description of the Prior Art

With the increasing spread of the vacuum switching in the medium—voltage range in devices, the control of higher cutoff currents is required. High currents even exceeding 40 kA must be shut off safely, while at the same time maintaining or even reducing the outside dimensions of the switching mechanism. Many special contact geometries have been suggested which conduct the switching current in an axial or longitudinal direction in the vicinity of the contact bodies. This generates between the contact pieces, during the switching operation, an axial magnetic field which brings about a switching arc distributed uniformly over the entire contact area.

In such contact configurations with axial magnetic field the following problem generally occurs: Due to the change in the current flowing across the contacts, eddy currents are induced in closed, ringshaped contact carriers in washer-shaped contact carriers or in contact rings. Such eddy currents generate secondary magetic fields which weaken the amplitude of the axial magnetic field and cause a phase shift relative to the current flowing through the switch. The effect of the phase shift of the axial magnetic field, however, is that during and after the current zero crossing a considerable residual axial magnetic field remains. This magetic field prevents the rapid discharge of the charge carriers within the contact gap and promotes an undesired reignition of the arc.

Various solutions for the prevention of eddy currents in vacuum switches with axial magnetic field have been proposed. For example, in DE-A No. 2 443 141 a contact arrangement is described with four hookshaped conductors extending radially and axially to generate the axial magnetic field and in which a diskshaped contact body is provided which is radially slotted for the prevention of eddy currents. DE-A No. 3 231 593 discloses a contact design of axial conductors which are formed by making several slots in the same direction in a cup contact to which a contact disk with radial slots is soldered. Moreover, in EP-A No. 0 055 088 conductors are illustrated shaped to generate the magnetic field, the current flowing repeatedly in the arc plane and the contact body being divided into several parts by wide slots.

The neccessity of radial slots in the contact body in contact arrangements for vacuum switches with axial magnetic field is also known in EP-A No. 0155 584 and EP-A No. 0 052 371. As an alternative thereto the use of suitable current barriers of a high-resistance material such as stainless steel and ceramic is also know. According to EP-A No. 0 052 371, such barriers can be inserted into the contact pieces with the actual contact body of a CuFe or CuCo alloy and the contact carrier underneath having the same geometry and consists of a CuPb or CuBi alloy, possible only at great cost.

In the technical literature (e.g., "IEEE Transactions on Power Apparatus and Systems" (1980), pages 2079 to 2085) conditions are described in detail under which slots are needed in the contact disk exposed to the arc for eddy current prevention.

Thus, in the present state of the art, the necessity of the slots as a suitable means of eddy current suppression is assumed. A disadvantage of this practice is that because of the broad, radial slots in the contact surface facing the arc, there are preferably formed at their edges cathode bases which can lead to reignitions due to thermal overheating. The same applies when the current barriers replacing the slots lead to macroscopic inhomogeneities on the switching surface of the contacts. Moreover, in this practice, the disks can be slotted only to about one third of the contact disk diameter to retain the stability of the contact body. Because of the lack of slots in the central area of the contact pieces, the eddy currents flowing there remain fully effective.

OBJECTS AND SUMMARY OF THE INVENTION

Therefore, it is an object of the invention to provide contact pieces for vacuum switches with an axial magnetic field in which eddy currents and residual axial magnetic fields coupled thereto in the current zero crossing are prevented without disturbing slots or other macroscopic inhomogenities impairing the contact surface of the contact body. Such contact bodies with means to suppress eddy currents are producible in a simple manner by known production technologies.

According to the invention, this problem is solved in that, starting at the backside of the contact body, the radial areas extend only over a portion of the contact body thickness, i.e. they do not extend to the switching surface of the contact body.

In other words, according to the invention axial-field contact systems are provided with contact bodies which are largely smooth on the switching surface, but yet have discontinuities in the conductivity for the suppression of eddy currents through radial areas with an electrical conductivity markedly lower than that of the contact material.

The radial areas are preferably formed by grooves on the contact body side away from the switching surface. The radial areas may also be diffusion zones of an additive material reducing the electrical conductivity of the contact material. The diffusion zones may start from grooves on the contact body surface opposite the switching surface.

Especially in contact bodies produced by powder metallurgy, the radial areas may comprise fillings or molded parts of a material poorer conductivity than that of the base material.

In the state of the art, fillings or molded parts per se are already mentioned as so called current barriers to replace the slots in contact bodies. But it is only within the scope of the teaching of the invention that when the molded parts for the contact body are produced by powder metallurgy, they can be introduced so that they leave the switching surface of the finished contact body unaffected. In particular, the switching surface can then be made completed of base material.

The invention offers the particular advantage that a mechanical stability sufficient for the soldering operation of the contact body to the contact carrier is assured. The switching characteristics of the contact body are not altered by the smooth contact surface of the contact body.

BRIEF DESCRIPTION OF THE FIGURES

Other advantages of the invention follow from the description below in conjunction with the Figures wherein.

DETAILED DESCRIPTION OF THE INVENTION

Figure 1:
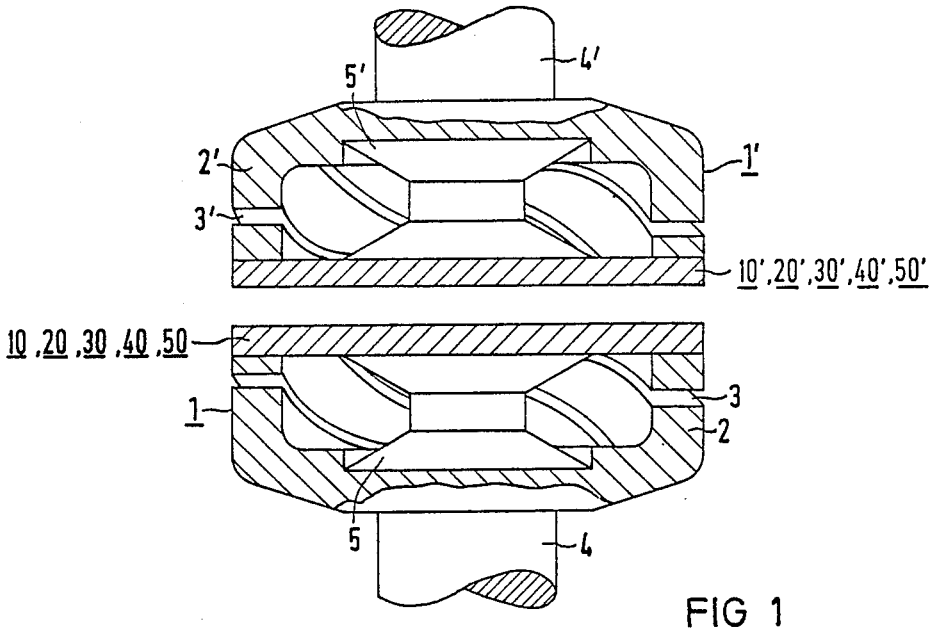
FIG. 1 shows a sectional view of arrangement for a vacuum switchgear with axial magnetic field, in accordance with this invention.

In FIG. 1, a contact 1 of a vacuum switch is comprised of a cuplike contact carrier 2 with oblique circular or helical slotting 3. A second piece has 1' has in a correspondence contact carrier 2' slotting 3' running in the same sense in axial direction so that, overall, an axial magnetic field is generated in response to a current flow. Corrected to the contact carrier 2,2' is a contact bolt 4,4,' respectively, made of copper or the like. Inserted in the contact carriers 2,2' is a supporting part 5,5' respectively, of electrically conducting material, e.g. chrome/nickel steel having in double T-shape as shown. Each contact piece also have a each diskshaped contact body 10, 10,' respectively, of a suitable contact material such as CuCr with 50% Cr. In the prior art, the contact body conventionally consists of a disk, into which radial slots are made, starting at the circumference to about two thirds towards the center. In order to assure adequate stability, the center of the disk is not slotted.

Figure 2:
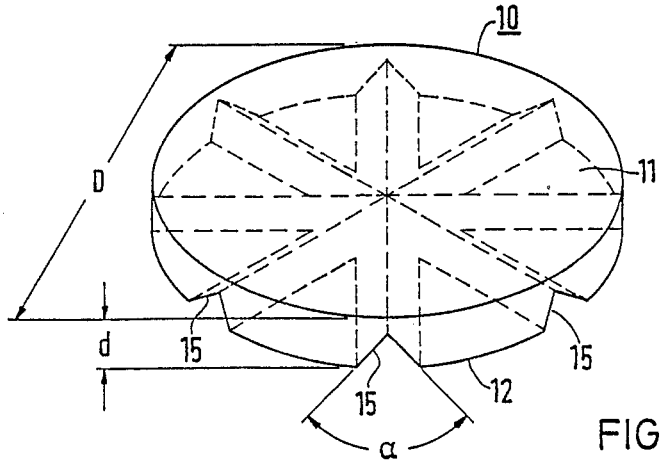
FIG. 2 to 4 snow three different embodiments of the associated contact bodies, in a perspective view.

In FIG. 2 in the present convention, the contact body 10 has a side surface and are opposing backside 12. Webs of reduced electrical conductivity are generated in the body by milling radially extending, wedge shaped grooves 15 from the back side. The wedge angle A may range from 10 to 90 degrees, for example. The wedge depth is designed so that the disk 10 still retains sufficient mechanical stability for soldering the body 10 to the contact carriers, 2,2' and the supporting parts 5,5,' respectively. The contact body 10 is oriented angularly so that the radial areas defined by the grooves 15 are aligned with the slottings 3,3' of the contact carriers 2,2.

With this design for the contact body with grooves 15, it can be shown that a limited effective depth of the electric current results due to the skin effect, thus assuring a suppression of undesired eddy currents.

Figure 3:
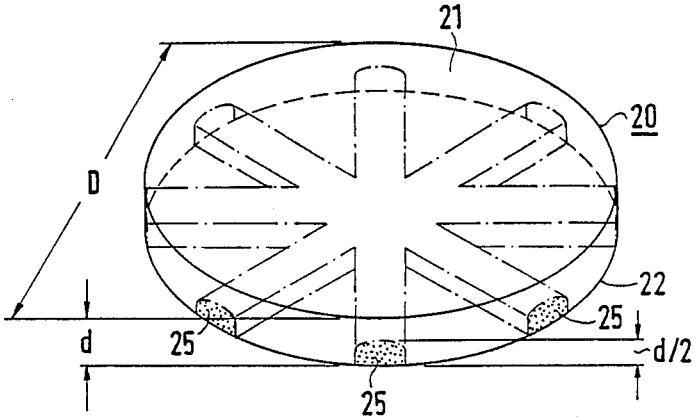
Figure 4:
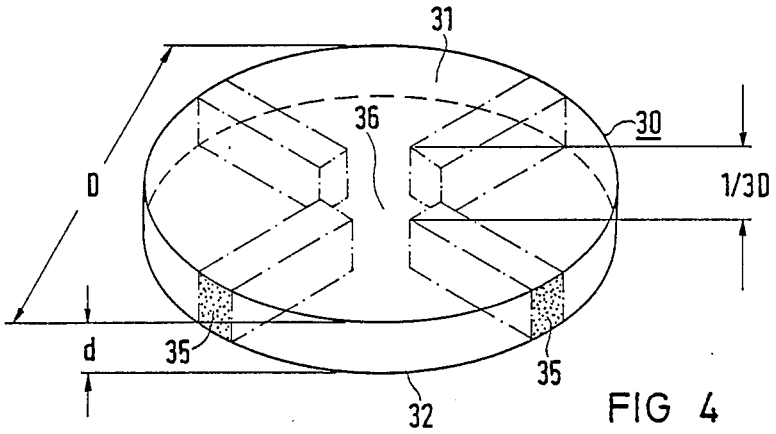

In FIG. 3, starshaped areas of lesser electrical conductivity than that of the base materials are produced in a contact body 20 having contacting side 21 and backside 22 by the local diffusion of suitable components. Components suitable for the diffusion zones, especially for a CuCr contact material, include for example, iron (Fe), cobalt (Co), nickel (Ni), titanium (Ti) or aluminum (Al), i.e. components forming a mixed crystal with copper, thereby reducing the electrical conductivity effectively.

To produce the starshaped areas 25 it is expedient to delimit the diffusion zones by masking. The diffusion occurs from the backside 22 of the contact piece 20.

Leaving either the contact pieces 10 and 20 with unaltered contact material on the entire switching side 11 or 21 or the contact piece 30 towards the central area 36 ensures the desired are distribution during the switching process.

It is also possible to construct a contact piece as a combination of FIGS. 2 and 3. In this combination, grooves are first produced in the contact piece from the backside, and the diffusion of the conductivity-reducing additive is effected from the base of the grooves.

Figure 5A:
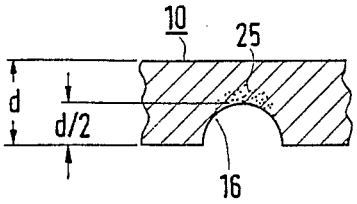
FIG. 5 A–C show various embodiments for the section of the grooves on the underside of the contact bodies.
Figure 5B:
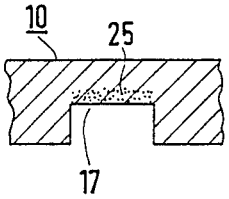
Figure 5C:
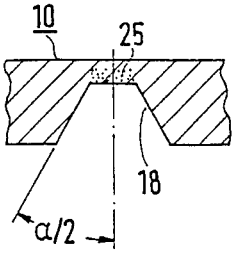

As shown in FIGS. 5 A–C the cross section of the grooves 15 may also be semi-circular 16, rectangular 17, or trapezoidal 18. Other geometric shapes are also possible. The grooves 16 to 18 may advantageously be the starting point of diffusion zones 25 FIG. 3.

Figure 6:
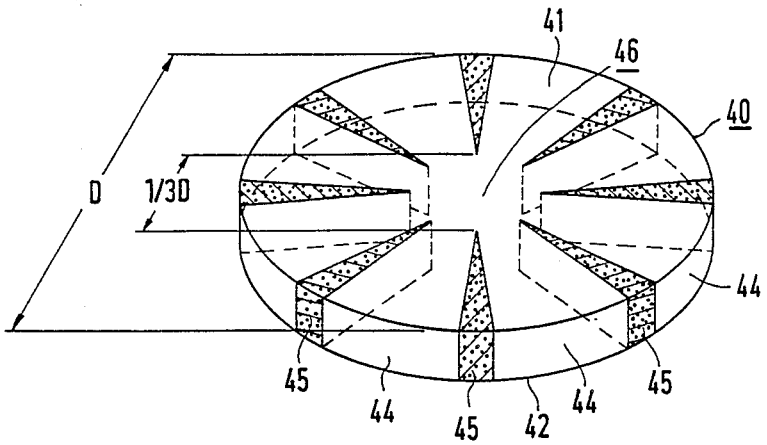
FIGS. 6 and 7 show two additional embodiments of contact bodies produced by powder metallurgy.
Figure 7:
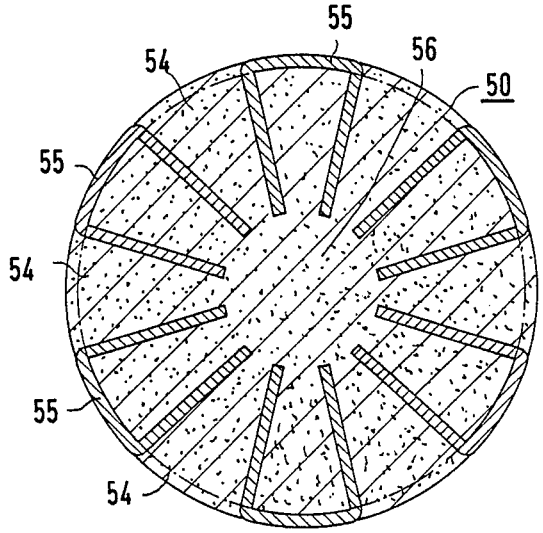

In FIGS. 6 and 7 are shown contact bodies 40 and 50 produced by the sinter infiltration method by impregnating a chromium skeleton with molten copper. Due to the powder metallurgical production technique of such disks 40 or 50 it is possible to generate, simultaneously with the production of the molded part, radial areas such as with a spoke or star shape, as webs of a less conductive material than the base material. To produce such contact bodies, segment like powder areas of materials are introduced into the powder fill which lead to the desired areas of reduced conductivity in the subsequent impregnation process. The layering of the different powders can be accomplished, for example, by sheet metal separators arranged in star shape and removed after the filling operation.

Through a suitable filling operation it is easy to produce radial areas which, according to the embodiement of FIG. 3 described for diffusion zones, end below the switching surfaces. It is also possible to bring into a specified position relative to the center of the circular disk radial segments emanting from the circumference. The boundaries may run in parallel or radially. It is recommended to select the areas as narrow as possible, but in greater numbers such as eight or more, but at least four, distributed over the disk in circular symmetry.

When employing a powder metallurgical production method, radially extending powder fillings can now be introduced directly into the molded part 20 with switching side 20 with the switching side 21 and soldering side 22 of FIG. 3, starting from the backside 22 to a region near the switching side 21 and forming roughly beamshaped webs 25 due to parallel barriers, intersecting in the disk center. The webs 25 define star or spoke-shaped areas and leave the contact surface 21 of the contact body 20 unaltered.

Where pressed parts shown in FIG. 6 are provided, different powder layers 44 and 55 may be present so that the powders of the material for the radial areas of lower conductivity remain in the finished material either dissolved, or undissolved. In the latter case, however, it must be seen to it by material selection that no homogeneous solution in the impregnating metal takes place. For example, in pressed Cr powder parts with embedded segments e.g. of iron (Fe) powder, the subsequent infiltration process leads to the partial or complete solution of the Fe powder particles, the Fe separating again in the form of FeCr on directly adjacent Cr grains of the impregnation material.

In FIG. 7, electrically poorly conducting areas 55 are provided as narrow webs in a contact body 50. But in this case, the base material areas 54 are specifically separated therefrom by metal sheets such as of iron (Fe), cobalt (Co), titanium (Ti), nickel (Ni), aluminum (Al) or alloys thereof. The sheets 55 may be pushed from the circumference radially into powder fill for the pressed part, which can be accomplished in a simple manner by suitably folded sheet metal strips. The height of the sheet metal strips is selected lower than the total thickness of the contact disk.

Due to the inserted metal strips 55, the sintering and infiltration process yields the desired webs of a conductivity lower than that of the base material. The outside of the contact body 50 can subsequently be turned to form the starshaped structure of the webs comprising the metal strips 55. However, a highly conductive central 56 remains in the contact body 50.

The contact bodies 10, 20, 30, 40 or 50 describe above in detail can be soldered without problem to the contact carriers 2 or 2' and the supporting parts 5 or 5' of the contact pieces 1 or 1,' respectively, according to FIG. 1. In so doing it is expedient to orient the different contact bodies so that the radial areas of lower electrical conductivity are appropriately coordinated with the slottings 3 or 3' of the contact carriers 2 or 2', respectively.

In the foregoing, a CuCr base material with 30 to 60% chromium may be used as contact material. Contacts according to the invention can also be produced using other contact material systems, e.g. or CuW or CuMo basis.

What is claimed is:

1. A contract arrangement for vacuum switches with axial magnetic fields comprising:

a first and second contact piece, each contact piece having a contact carrier and a contact body soldered to said contact carrier, each body having a contacting surface and a back surface, said contacting body being made of a base material and having radial areas of lower conductivity than said base material for the reduction of eddy currents, said radial areas extending from said back surface toward said contacting surface across only a portion of said contact body.

2. The contact arrangement according to claim 1, wherein said radial areas are narrow as compared to circular segments of base material therefore with at least four radial areas being distributed in said contact body in circular symmetry.

3. The contact arrangement according to claim 1, wherein said areas have parallel boundaries which form beamshaped webs in said contact body.

4. The contract arrangement allowing to claim 1 wherein said areas have radial boundaries to form wedges with a base area of circular sector in said contact body.

5. The contact arrangement according to claim 1, wherein said radial areas emanating from a circumference of the contact body, extend towards a central area of said contract body to leave an uninterrupted, high electrical conductivity region.

6. The contact arrangement according to claim 1, wherein said radial areas are formed by grooves on said back surface, said grooves having one of a triangular, rectangular or semicircular cross section.

7. The contact arrangement according to claim 1, wherein said radial areas are diffusion zones of additives in the base material of the contact bodies, reducing the electrical conductivity of the base material by mixed crystal formation, said additives being diffused in from said back surface, and the diffusion depth being at least 50% of the thickness of the contact body, but less than its total thickness.

8. The contact arrangement according to claim 6 wherein said radial areas are formed by grooves on said back surface and by diffusion zones which start from said grooves and which, starting from the base of the grooves, reach at least 50% of the remaining thickness of the contact body, but reach less than its total thickness.

9. The contact arrangement according to claim 1, wherein said contact body is a molded part which produced by powder metallurgy and has, emanating from said back surface, radial areas of a material of lower electrical conductivity than that the base material.

10. The contact material according to claim 9 wherein said radial areas are filled with a powder of a material of lower electrical conductivity, selected from the group consisting of metallic materials and insulating materials.

11. The contact arrangement according to claim 9, wherein molded parts of a material of markedly lower electrical conductivity than the base material are introduced into the contact body.

12. The contact arrangement according to claim 1 wherein said contact body consist of a CuCr material with a chromium content between 30 and 60% by weight.

13. The contact arrangement of claim 12 wherein said chromium content is at least 50% by weight.

14. The contact arrangement according to claim 1, wherein the additive reducing the electrical conductivity of the base material by diffusion is selected from the group of elements consisting of iron, nickel, cobalt, aluminum, titanium, zirconium, antimony, tin, silicon or a combination of these elements.

15. The contact arrangement according to claim 10, wherein in that the metallic materials to fill the radial areas in the contact body produced by powder by metallurgy are selected from the group consisting of iron, cobalt, nickel, silicon, titanium, zirconium, combinations or alloys thereof.

* * * * *